United States Patent [19]

Tanaka

[11] Patent Number: 4,567,629

[45] Date of Patent: Feb. 4, 1986

[54] BUCKLE DEVICE

[75] Inventor: Tohbun Tanaka, Aichi, Japan

[73] Assignee: Kabushiki Kaisha Toka-rika-denki-seisakusho, Aichi, Japan

[21] Appl. No.: 575,579

[22] Filed: Jan. 31, 1984

[30] Foreign Application Priority Data

Feb. 7, 1983 [JP] Japan ..... 58-16464[U]

[51] Int. Cl.[4] ..... A41F 1/00

[52] U.S. Cl. ..... 24/653; 24/635; 24/644; 24/651; 297/471

[58] Field of Search ..... 24/653, 654, 632, 635, 24/639, 640, 644, 648, 649, 638, 650, 652, 171, 181; 297/468, 471, 472

[56] References Cited

U.S. PATENT DOCUMENTS

| | | | |
|---|---|---|---|
| 1,693,514 | 11/1928 | Johnson | 24/651 |
| 2,807,066 | 9/1957 | Honey et al. | 24/644 |
| 3,336,641 | 8/1967 | Hunter | 24/653 |
| 3,355,781 | 12/1967 | Silberschlag | 24/644 |
| 3,796,461 | 3/1974 | Cucheran et al. | 24/653 |
| 4,317,263 | 3/1982 | Fohl | 24/635 |
| 4,457,251 | 7/1984 | Weman et al. | 297/472 |

FOREIGN PATENT DOCUMENTS

| | | | |
|---|---|---|---|
| 751599 | 1/1967 | Canada | 24/644 |
| 351554 | 4/1922 | Fed. Rep. of Germany | 24/171 |
| 7602125 | 9/1977 | Netherlands | 24/653 |

*Primary Examiner*—Victor N. Sakran

*Attorney, Agent, or Firm*—Thomas W. Cole

[57] ABSTRACT

In a buckle device in which a tongue plate is inserted into a buckle body secured to a vehicle body and is latched to a lock lever disposed in the buckle body, an opening portion of the tongue plate and a pawl of the lock lever are caused to contact with each other at two points spaced in a predetermined distance and a clearance is formed between the opening portion and the pawl in respect of the two points.

In an ordinary situation of the vehicle the clearance is kept smooth, and, when a large load acts upon the tongue plate in an emergency situation of the vehicle, the contact portions of the opening portion and the pawl at the two points are deformed, whereby portions of the opening portions and the pawl existing between both the points are caused to contact with each other.

Accordingly, the lock lever is capable of being operated with a small force and the tongue plate can be pulled out of the buckle device smoothly.

18 Claims, 5 Drawing Figures

BUCKLE DEVICE

BACKGROUND OF THE INVENTION

1. Field of the Invention

The present invention relates to a buckle device adapted for use in seatbelt system for protecting an occupant in an emergency situation of such a vehicle as an automobile or an airplane and more particularly to a buckle device improved in locking portion between a lock lever and a tongue plate.

2. Description of the Prior Art

As is well known, the buckle device is such constructed that a tongue plate secured to one end of an occupant-restraining webbing is inserted into a buckle body and a lock lever disposed in the buckle body is latched to an opening portion of the tongue plate to prevent the tongue plate from being pulled out, whereby an occupant is placed in his webbing-fastening situation.

Also, in case that the occupant releases the webbing-fastening situation, he pushes down a release button mounted on the buckle body to cause the lock lever to separate from the opening portion of the tongue plate, thereby to pull the tongue plate out of the buckle body.

FIGS. 1 and 2 are a plan view and a sectional view showing a locking portion of a conventional buckle device.

A buckle body 10 is provided therein with a lock lever 12, and a pawl 14 formed on the lock lever 12 is caught in an opening portion 18 of a tongue plate 16 inserted in the buckle body 10. In this case, the pawl 14 usually contacts with the opening portion 18 approximately at their center portions 19, as shown in FIG. 1, but the contact portions of the pawl 14 and the opening portion 18 are moved in accordance with variations of load acting upon the webbing. That is to say, in such a condition that the tongue plate 16 is locked into the buckle body 10 a clearance exists between the inside of the buckle body 10 and each of both side edges of the tongue plate 16, and in such a condition the tongue plate 16 is slightly rotatable centering around the center portions 19 in directions of the width of the buckle body 10. Therefore, the contact portions of the pawl 14 and the opening portion 18 are moved rotatably centering around the center portions 19 due to changes of attitude of the occupant fastened by the webbing or the like.

Accordingly, the pawl 14 and the opening portion 18 of the tongue plate 16 are caused to contact with, or rub against, each other approximately all over their locking faces in accordance with increase in number of use of the buckle device, and the locking faces are made rough approximately in their whole surfaces, whereby most of the respective locking faces is decreased in smoothness and the friction between both the locking faces is increased approximately all over the locking faces. As a result, when a large load acts upon the webbing, for example, when the centre portions 19 are deformed or crushed in such an emergency situation of the vehicle as a collision and the contact portions of the opening portion 18 and the pawl 14 are enlarged, portions of the opening portion 18 and the pawl 14 newly caused to contact with each other in the emergency situation have already been made rough, i.e., they have already been increased in frictional force therebetween, as set forth above, and, therefore, in order to release the tongue plate 16 from the pawl 14 it is required that a release button (not shown) mounted on the buckle body 10 is operated with a large force, or power.

SUMMARY OF THE INVENTION

In view of the above facts, the present invention has as its object the provision of a buckle device in which a lock lever provided in a buckle body and a tongue plate fixed to an occupant-restraining webbing are capable of being released from their locking situation by a small releasing force even in such a condition that a large load acts upon the webbing.

In the buckle device according to the present invention, a locking face of a pawl of the lock lever and a locking face of an opening portion of the tongue plate are caused to contact with each other only at two points under a locking situation of the buckle device, and under such a situation a clearance is formed between both the locking faces in their intermediate portions. Therefore, the intermediate portions of both the locking faces are protected from being made rough in an ordinary use of the buckle device. Also, in an emergency situation of a vehicle, such as a collision, when a large load acts upon the webbing, both the contact portions of both the locking faces are deformed and the intermediate portions are caused to contact with each other, whereby the locking situation between the lock lever and the tongue plate can securely be maintained in the buckle device. In addition, the intermediate portions are kept smooth owing to that they do not contact with each other in the ordinary use of the buckle device, so that a contact friction between the intermediate portions is not increased, which does not obstruct a release of the lock lever from the tongue plate.

In another aspect of the buckle device according to the present invention, the pawl of the lock lever and an inner surface of an inlet portion of the buckle body are subjected to a polytetrafluorethylene coating, whereby the release of the lock lever from the pawl, and insertion and pulling-out of the tongue plate can be conducted more smoothly.

Description will hereinunder be given of embodiments of the present invention with reference to the attached drawings.

DESCRIPTION OF THE PREFERRED EMBODIMENTS

Figure 1:
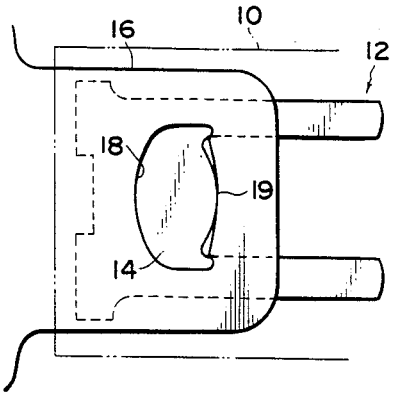
FIG-1 PRIOR ART
FIGS. 1 and 2 are a plan view and a sectional view showing a conventional buckle device.
Figure 2:
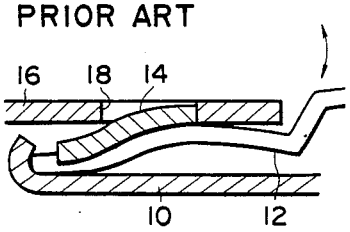
FIG-2 PRIOR ART
Figure 3:
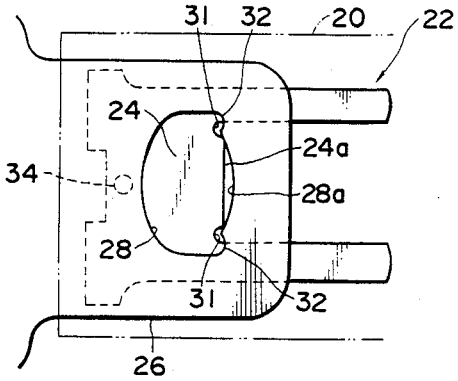
FIG. 3 is a plan view of a first embodiment of a buckle device according to the present invention.
Figure 4:
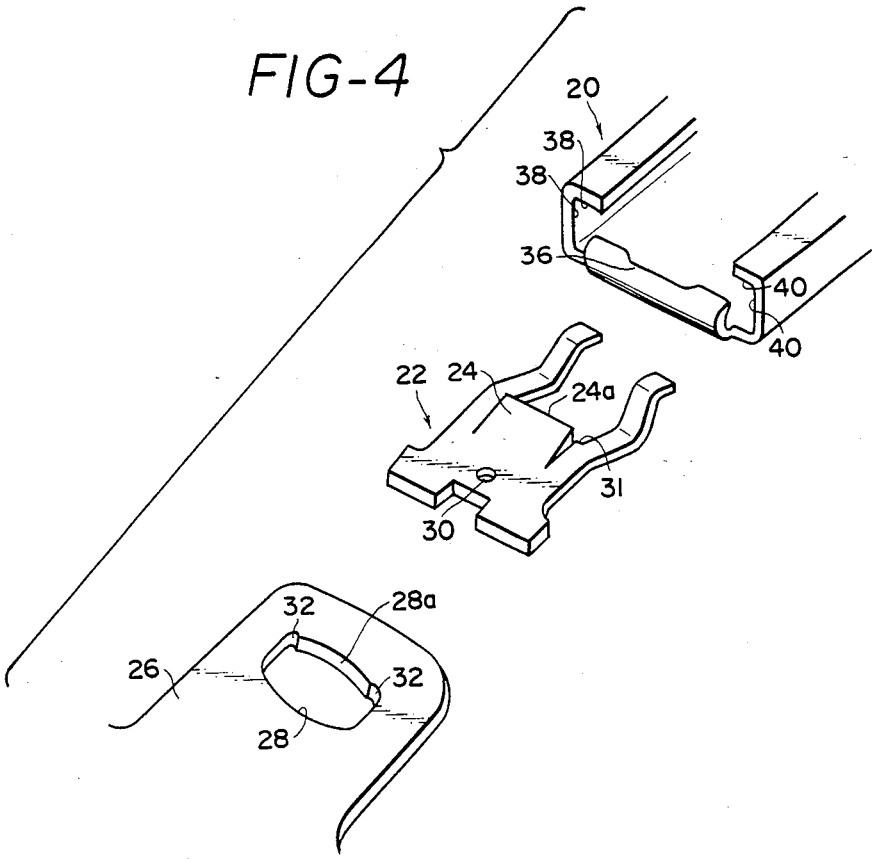
FIG. 4 is a disassembled view of the buckle device of FIG. 3.

FIG. 3 is a magnified plan view showing a locking situation of a buckle device of the present invention and FIG. 4 is a disassembled view of the buckle device.

In a buckle body 20 (shown with a double-dotted chain line in FIG. 3), a pawl 24 of a lock lever 22 is latched to an opening portion 28 of a tongue plate 26. As is well known, secured to the tongue plate 26 is one end of an occupant-restraining webbing (not shown), and mounted on a rear end portion (a right side in FIG. 3) of the buckle body 20 are a connecting plate and an anchor (not shown).

Formed at a forward end portion of the lock lever 22 is a hole 30 in which a spring (not shown) is received. The spring always biases the pawl 24 of the lock lever 22 in such a direction as to cause the pawl 24 of the lock lever 22 to abut against the opening portion 28 of the tongue plate 26. The lock lever 22 is provided on its upper face with a release button (not shown), and when the button is pushed down, the lock lever 22 is pushed down against a biasing force of the spring, so that the locking situation between the lock lever 22 and the tongue plate 26 is released.

In the embodiment the pawl 24 of the lock lever 22 has a locking face 24*a* of a substantially flat shape abutting against the opening portion 28 of the tongue plate 26, and the locking face 24*a* is formed at its both sides with notches 31, as shown in FIGS. 3 and 4. On the other hand, the opening portion 28 of the tongue plate 26 also has a locking face 28*a* of a substantially curved shape formed at its both sides with recess portions 32. Accordingly, when the pawl 24 of the lock lever 22 is latched to the opening portion 28 of the tongue plate 26, both the locking faces 24*a* and 28*a* contact with each other only at two points and a predetermined clearance is formed between both the locking faces 24*a* and 28*a* in their intermediate portions.

Thus, in an ordinary use of the buckle device the respective locking faces 24*a* and 28*a* of the pawl 24 and the opening portion 28 are little worn away, i.e. they are made little rough, and the smoothness in each of the locking faces 24*a* and 28*a* is protected from being decreased. In addition, when a large load acts upon the webbing and the tongue plate 26 in an emergency situation of a vehicle, such as a collision, the contact portions of both the locking faces 24*a* and 28*a* are crushed or deformed, so that the contact areas thereof are enlarged, but, as most of the locking faces 24*a* and 28*a* are kept smooth, a friction occurring at a time of the release of the tongue plate 26 from the lock lever 22 is kept small. Therefore, when an occupant fastened by the webbing escapes from the vehicle, he can release the pawl 24 from the opening portion 28 of the tongue plate 26 with a small releasing force required therefor.

There are several means for forming the clearance between the locking face 24*a* and the locking face 28*a* besides this embodiment. For example, formed at both the end portions of the locking face 24*a* of the pawl 24 can be two projections contacting with the locking face 28*a* of the opening portion 28.

Figure 5:
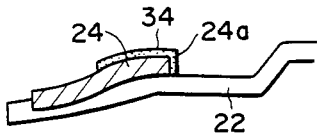
FIG. 5 is a sectional view showing a second embodiment of the present invention.

FIG. 5 shows another embodiment in which the releasing property between the lock plate and the tongue plate is much enhanced. As noted from FIG. 5, the pawl 24 of the lock lever 22 is subjected to a polytetrafluorethylene coating. All surfaces of the pawl 24 is not required to be coated with the polytetrafluorethylene film 34 but it meets the enhancement of the releasing property that only the locking face 24A and a part of an upper surface of the pawl contacting with the tongue plate 26 at the time of the release thereof are coated with the film 34. The formation of the film 34 enhances a wear resistance and a corrosion resistance of the pawl 24 and it decreases a frictional force occurring between the locking face 24*a* of the pawl 24 and the locking face 28*a* of the opening portion 28, to thereby improve the releasing property between the lock lever 22 and the tongue plate 26.

Furthermore, in case that an inlet portion of the buckle body 20 shown in FIG. 4, especially portions 36, 38 and 40 contacting with the tongue plate 26 in times of its insertion and pulling-out, is also subjected to the polytetrafluorethylene coating, the insertion and pulling-out of the tongue plate 26 can be performed still more smoothly.

In this second embodiment the polytetrafluorethylene commercially available as Teflon S (Trade Mark) is used. The Teflon S is a relatively novel coating material, and it reveals a relatively strong adhesion property by its one coating, a film thereof being hard and being excellent in a wear resistance. Of course, other polytetrafluorethylene materials can also be applied to the present invention.

What is claimed is:

1. A buckle device adapted for use in a seatbelt system for protecting an occupant in an emergency situation of a vehicle, comprising:

(a) a buckle body fixed to a vehicle body;

(b) a lock lever provided in the buckle body and operated by a releasing force applied by the occupant;

(c) a tongue plate connected to an occupant-restraining webbing which is receivable in the buckle body; and (d) a locking mechanism provided between the lock lever and the tongue plate for preventing the tongue plate from being pulled out, the locking mechanism including an opening portion formed in the tongue plate, and a pawl formed on the lock lever which is insertable within the opening portion, the opening portion and the pawl contacting with each other at two deformable points spaced in a predetermined distance, and a clearance portion being formed between both the contact points of the opening portion and the pawl, wherein when a large load acts upon the webbing and the tongue plate in the emergency situation of the vehicle, the contact points are deformed, the opening portion and the pawl are caused to contact with each other in the clearance portion in a contact condition of low frictional engagement in order to prevent the amount of releasing force required to separate the lock lever and the tongue plate from each other from increasing.

2. A buckle device as set forth in claim 1, wherein the opening portion of the tongue plate is formed in a curved shape at its locking face opposed to the pawl and the pawl contacts with the opening portion in the neighborhoods of both the ends of the curved portion of the opening portion.

3. A buckle device as set forth in claim 2, wherein small recess portions are formed at parts of the opening portion sequent to both the end of the curved portion.

4. A buckle device as set forth in claim 1, wherein the pawl of the lock lever is formed in a substantially flat shape at its locking face opposed to the tongue plate and notches are formed at both the end portions of the locking face, boundary portions between the flat portion of the pawl and both the notches being caused to contact with the tongue plate.

5. A buckle device as set forth in claim 4, wherein the pawl is formed projectingly from the other portions of the lock plate.

6. A buckle device as set forth in claim 1, wherein both the contact portions are positioned on a line perpendicular to directions of insertion and pulling-out of the tongue plate.

7. A buckle device as set forth in claim 1, wherein the pawl is coated with a synthetic resin.

8. A buckle device adapted for use in a seatbelt system, comprising:

(a) a buckle body of a box type secured to a vehicle body;

(b) a tongue plate formed with an opening portion and connected to an occupant-restraining webbing;

(c) a lock lever disposed in the buckle body and provided with a pawl latchable with the opening portion to prevent the tongue plate inserted in the buckle body from being pulled out; and (d) means putting the opening portion and the pawl in a latched condition at two deformable points positioned in a line perpendicular to the direction of inserting and pulling-out of the tongue plate relative to the buckle device, wherein in an ordinary situation of the vehicle the tongue plate and the lock lever are kept in contact at the two points, and, when a large load acts upon the webbing and the tongue plate in an emergency situation of the vehicle, the contact portions of the tongue plate and the lock lever at the two points are deformed and portions of the tongue plate and the lock lever existing between both the points are prevented from forcefully engaging with each other, so that the pawl of the lock plate can be released from the opening portion of the tongue plate with a small force.

9. A buckle device as set forth in claim 8, wherein the opening portion of the tongue plate is formed in a curved shape at its locking face opposed to the pawl and the pawl contacts with the opening portion in the neighborhoods of both the ends of the curved portion of the opening portion.

10. A buckle device as set forth in claim 9, wherein small recess portions are formed at parts of the opening portion sequent to both the end of the curved portion.

11. A buckle device as set forth in claim 8, wherein the pawl of the lock lever is formed in a substantially flat shape at its locking face opposed to the tongue plate and notches are formed at both the end portions of the contact portion, boundary portions between the flat portion of the pawl and both the notches being caused to contact with the tongue plate.

12. A buckle device as set forth in claim 11, wherein the pawl is formed projectingly from the other portions of the lock plate.

13. A buckle device as set forth in claim 8, wherein the pawl is coated with a synthetic resin.

14. A buckle device adapted for use in a seatbelt system for protecting an occupant in an emergency situation of a vehicle, comprising:

(a) a buckle body secured to a vehicle body;

(b) a lock lever provided in the buckle body and operated by the occupant;

(c) a tongue plate secured to its portion with an occupant-restraining webbing which is receivable within the buckle body; and (d) a locking mechanism provided between the lock lever and the tongue plate for preventing the tongue plate from being pulled out but which will release the tongue plate upon the application of a releasing force on the lock lever, the locking mechanism including an opening portion formed on the tongue plate, and a pawl formed projectingly on the lock lever, the opening portion and the pawl having locking faces opposed to each other when the tongue plate is locked to the buckle body in which the locking faces contact with each other only at two small areas along the width of the pawl, wherein when a large load acts upon the webbing and the tongue plate in the emergency situation of the vehicle, the two small areas are deformed, and the locking faces are caused to contact with each other at portions between the two small areas with low frictional engagement so that the releasing force required to separate the lock lever and the tongue plate from each other remains substantially unchanged.

15. A buckle device as set forth in claim 14, wherein one of the locking faces of the pawl and the opening portion is formed in a curve from the two small areas in directions separating from the other of the locking faces.

16. A buckle device as set forth in claim 14, wherein the two small areas are a pair of projections formed on one of the locking faces of the pawl and the opening portion.

17. A buckle device as set forth in claim 14, wherein the pawl is coated at its portion with a synthetic resin.

18. A buckle device for use in a seatbelt system for protecting an occupant in an emergency situation of a vehicle, comprising:

(a) a buckle body connected to a vehicle;

(b) a lock lever provided in the buckle body an operated by the occupant;

(c) a tongue plate connected to an occupant-restraining webbing which is receivable in the buckle body, and (d) a locking mechanism for preventing the tongue plate from being pulled out of the buckle body, but which will release the tongue plate from the buckle body upon the application of a releasing force on the lock lever, the locking mechanism including an opening portion formed on the tongue plate and a pawl formed projectingly on the lock lever, the opening portion in the pawl having locking faces opposed to each other when the tongue plate is locked to the buckle body in which the locking faces make contact with one another at only two points along the width of the pawl, and wherein the material which forms the locking faces is deformable, wherein the material at said two contact points will deform upon the application of a load above a certain magnitude on the webbing, but will continue to prevent the locking faces from coming into substantial engagement with one another, whereupon the amount of releasing force required on the lock lever to release the tongue plate from the buckle body remains substantially unchanged.

* * * * *